United States Patent [19]

Lin

[11] Patent Number: 5,052,613

[45] Date of Patent: Oct. 1, 1991

[54] TWO-WAY ENVELOPE

[76] Inventor: Sheng-Chi Lin, 6410 Terese Ter., Jamesville, N.Y. 13078

[21] Appl. No.: 533,806

[22] Filed: Jun. 6, 1990

Related U.S. Application Data

[63] Continuation-in-part of Ser. No. 286,408, Dec. 19, 1988, abandoned.

[51] Int. Cl.[5] ..... B65D 27/04; B65D 27/06

[52] U.S. Cl. ..... 229/73; 229/71

[58] Field of Search ..... 206/616, 618; 229/71, 229/73, 81

[56] References Cited

U.S. PATENT DOCUMENTS

| | | | |
|---|---|---|---|
| 36,393 | 9/1862 | Brown | 229/71 |
| 86,722 | 4/1869 | Klaucke et al. | 229/73 |
| 89,507 | 4/1869 | Saladee | 229/73 |
| 484,372 | 10/1892 | Kohn | 206/618 |
| 701,839 | 6/1902 | Collahan | 229/73 |
| 999,965 | 8/1911 | Coustley | 206/618 |
| 1,220,796 | 3/1917 | Sutter | 206/616 |
| 1,245,447 | 11/1917 | Felenchak | 229/73 |
| 1,491,675 | 4/1924 | Conklin | 229/73 |
| 1,550,750 | 8/1925 | Shannon | 206/618 |
| 1,896,425 | 2/1933 | Scarfi | 206/618 |
| 1,925,522 | 6/1877 | Marshall | 229/73 |
| 3,365,117 | 1/1968 | Powell, Jr. | 229/71 |
| 3,512,702 | 5/1970 | Pritchard, Jr. | 229/73 |
| 3,545,669 | 12/1970 | Kinkade et al. | 229/73 |
| 4,384,670 | 5/1983 | Dicker | 229/73 |
| 4,706,877 | 11/1987 | Jenkins | 229/73 |

FOREIGN PATENT DOCUMENTS

| | | | |
|---|---|---|---|
| 141902 | 10/1930 | Fed. Rep. of Germany | 229/73 |
| 1080221 | 5/1954 | France | 229/73 |
| 1400575 | 4/1965 | France | 229/73 |
| 994 | of 1914 | United Kingdom | 229/73 |
| 120003 | 10/1918 | United Kingdom | 229/73 |

*Primary Examiner*—Stephen P. Garbe

*Attorney, Agent, or Firm*—Charles S. McGuire

[57] ABSTRACT

An envelope intended for use in both original and return mailings includes a removable and reuseable address label in one of the mail-to and return address locations on the front panel. Removal of the label creates a window, which may optionally be covered by a transparent liner, for viewing an address on a portion of the envelope contents placed behind the window. Removal of the label is facilitated by slit perforations forming portions which may easily be grasped for lifting and removing the label which has an adhesive on its rear surface for affixing it to the envelope in the mail-to or return address location opposite its original position. The envelope flap includes two adhesive-coated areas, separated by perforations, for individual use in the forward and return mailings.

20 Claims, 4 Drawing Sheets

TWO-WAY ENVELOPE

REFERENCE TO RELATED DOCUMENTS

The present application is a continuation-in-part of my copending application Ser. No. 07/286,408, filed 12-19-88 now abandoned.

BACKGROUND OF THE INVENTION

This invention relates to envelopes used for mailing correspondence from one place to another and, more particularly, to novel and unique envelopes which include means to permit a first mailing of the envelope to a first destination from an origination point, and a second mailing of the same envelope from the first destination point back to the origination point.

In many instances an envelope is mailed from an originating sender to an addressee with the intention that a return mailing be made to the originating sender. This is particularly common in mailings involving commercial transactions as, for example, when an invoice or other statement of account is mailed to an addressee who is expected to mail a payment back to the original sender. It is presently a widespread practise for the original sender to enclose in the first envelope a second envelope for the convenience in making the return mailing. One or both of the two envelopes may have a window, either open or covered by a transparent liner, for viewing either or both of the addresses in the mail-to or return address locations on the envelope. These addresses commonly appear on pre-printed portions of the envelope contents in appropriate positions for viewing through the window(s).

Although the prior art contains many examples of envelopes adapted for use in both forward and return mailings, each suffers from particular limitations, accounting for the usual use of separate envelopes for the two mailings. This obviously adds to the proliferation of paper which must be transported from place to place and ultimately disposed of. A single envelope suitable for use in both forward and return mailings should include an address label in either the mail-to or return address location on the front of the envelope which may be conveniently removed and placed in the opposite location for the return mailing. The envelope flap should also have adhesive means suitable for sealing the envelope for both forward and return mailings.

OBJECTS AND ADVANTAGES

It is therefore a main object of the present invention to provide a reusable envelope in which the receiver can reply to the sender.

It is a further object of the present invention to minimize or significantly reduce unnecessary amounts of paper needed for the two mailings of material between the same parties.

Another object is to provide a mailing envelope having an improved, removable and reuseable address or return address label.

A still further object is to provide an envelope having an improved sealing flap suitable for use in both first and second mailings.

Other objects will in part be obvious and will in part appear hereinafter.

SUMMARY OF THE INVENTION

In accordance with the foregoing objects and advantages, the invention comprises an envelope which includes means for two separate mailings between two parties using the same envelope. In a first embodiment, a label in the conventional mail-to location on the envelope is formed by spaced perforations cut into the front face of the envelope. The first sender imprints the name and address of the first addressee thereon while imprinting its own name and address at the usual return-address location on the envelope. When the first addressee receives the envelope and wishes to mail a predetermined portion of the correspondence back to the first sender, e.g., a payment stub including the name and address of the first sender thereon, the first addressee removes the mail-to label on the envelope bearing his/her name and address and affixes it at the proper return-address location on the envelope by an adhesive applied to the back surface of the label. The label should effectively conceal the name and address of the first sender previously imprinted at the return-address location and thus serve as the new return-address for the second mailing of the envelope.

With the label thus removed from the mail-to location on the envelope, a window is formed which may include a transparent liner to protect the correspondence deposited in the envelope. When the first addressee deposits the appropriate portion of the correspondence received back into the envelope, the name and address of the first sender imprinted on the correspondence should appear through the window and thus serve as the new mail-to address for the second mailing of the envelope.

A second embodiment of the envelope is essentially the reverse of the first embodiment, i.e., the return-address location on the envelope includes the perforated label for removal thereof to be affixed at the mail-to location on the envelope, thereby providing a window at the return address location.

Two alternative means are provided for resealing the envelope for the second mailing. The first means comprises a string incorporated in the flap between two separately sealable regions. The first addressee pulls an exposed portion of the string, tearing the flap into two portions, one of which is sealed for the first mailing. This allows the unsealed portion of the flap to be lifted to access the correspondence therein. When the envelope is to be mailed back to the original sender, a liner is removed from the lifted flap to expose additional adhesive which allows the envelope to be resealed for the second mailing.

The second resealing means comprises perforated portions on the sealing flap including a pressure-sensitive adhesive, the remaining portion of the flap being coated with a moisture-sensitive adhesive. The pressure-sensitive portions seal the flap for the first mailing. When opened by the first addressee, those portions remain affixed to the back of the envelope by tearing around the perforations while the rest of the flap may be lifted therefrom. The flap may then be moistened for resealing of the envelope for the second mailing.

BRIEF DESCRIPTION OF THE DRAWINGS

The specifics shown in the drawings are intended to exemplify, rather than limit, aspects of the invention as defined in the claims.

DETAILED DESCRIPTION

Figure 1:
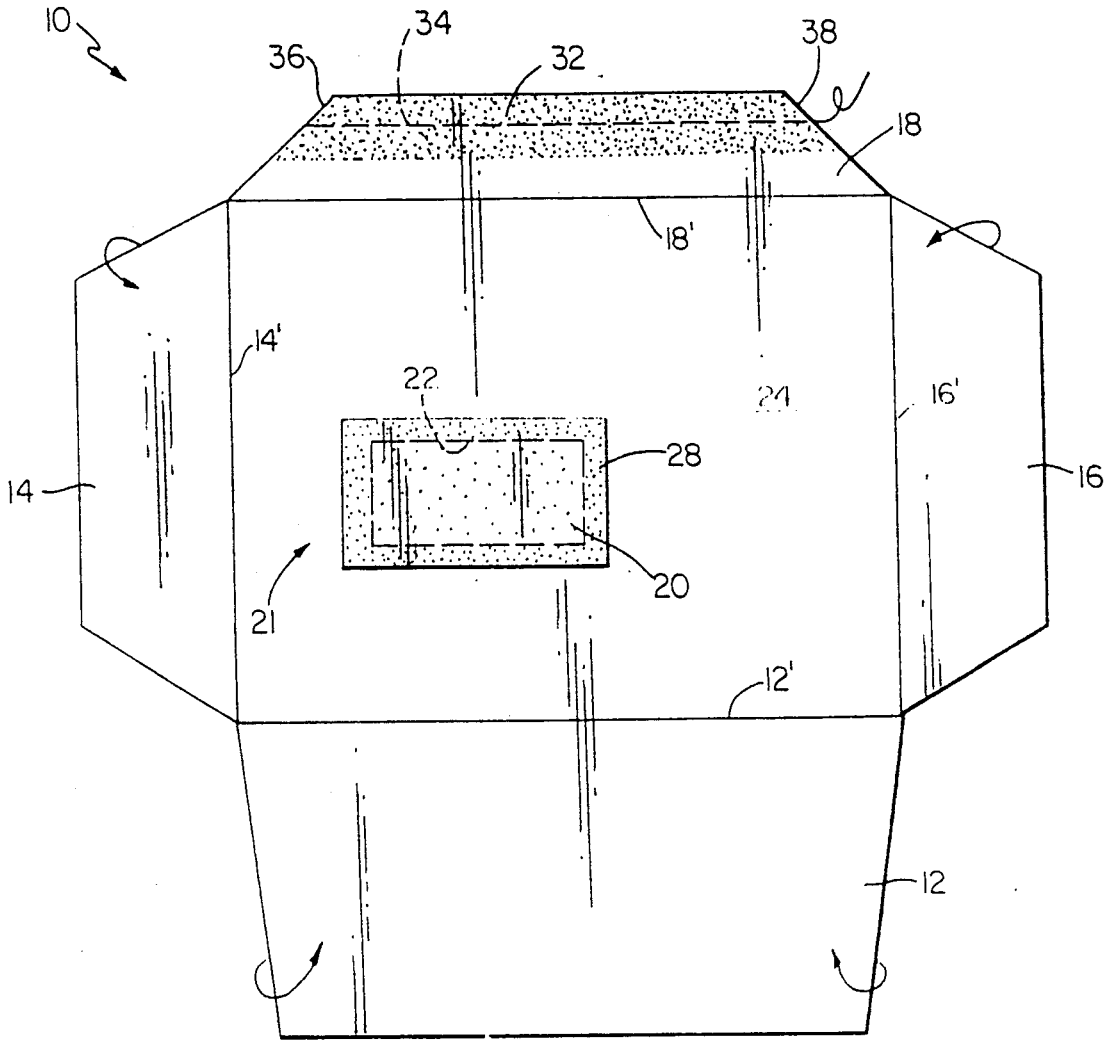
FIG. 1 is a plan view of the rear surface of a blank for preparing a first embodiment of the envelope of this invention, showing a removable label positioned at a first location on the envelope.

Referring now to the drawings, there is seen in FIG. 1 an unfolded envelope blank designated generally by the reference numeral 10 having a bottom flap 12, side flaps 14 and 16, and gummed, top flap 18. Flaps 12, 14 and 16 are foldable along lines 12', 14' and 16', respectively, in the direction of the arrows and include known sealing means to form a folded envelope for the deposit of correspondence therein. It is noted that the plan views of the unfolded blanks FIGS. 1 and 2 reveal what become the inside surfaces of the various parts of the envelope after the blank is folded and sealed. Flap 18 is folded on line 18' and sealed after correspondence is placed in the envelope.

Figure 1A:
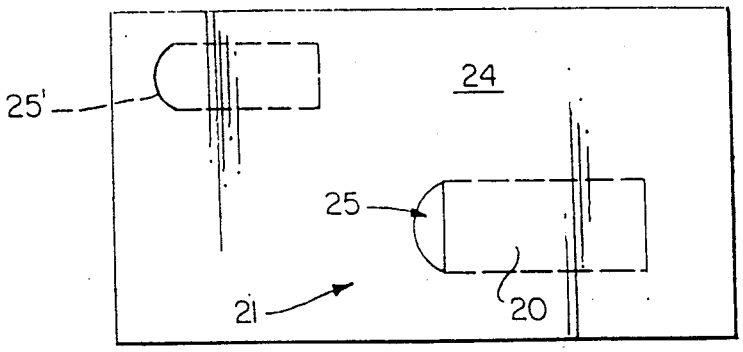
FIG. 1*a* is a plan view of the outside, front surface of an envelope prepared from the blank of FIG. 1, showing alternative label removing means.

In a first embodiment, blank 10 includes a label 20 which is located at the conventional mail-to location 21 on the front of the envelope 10. Label 20 is formed by perforations 22 cut through blank 10. Perforations 22, which are seen to define a rectangular label 20, are cut at predetermined, spaced intervals such that label 20 remains intact and an integral part of envelope face 24 until it is forceably removed by manual grasping of a corner of label 20 and pulling to tear label 20 from face 24 along the perforations 22. In this respect, perforations have been cut at all four corners of label 20 to ease the manual lifting of a corner of label 20 in preparation for removal thereof from face 24. An alternate means of easing manual lifting of label 20 may be seen in FIG. 1*a* wherein a cut-out opening or notch 25 is provided along one of the short sides of label 20 for insertion of one's finger, making grasping and removal of label 20 easier. Rather than removing a portion of the envleope to form an open notch, a removable label may be formed to include an arcuate slit at one end, as indicated by numeral 25' at the return address location of the envelope of FIG. 1*a*.

Figure 3:
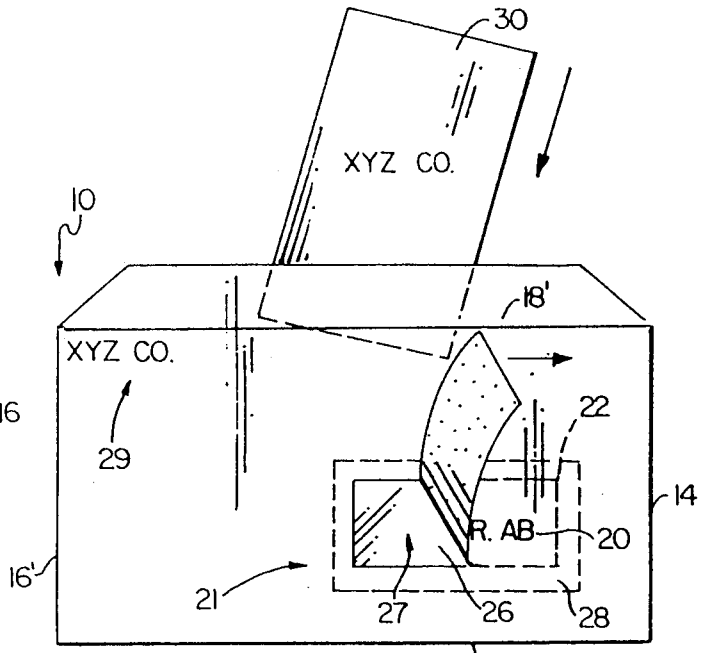
FIG. 3 is a front view of an unsealed envelope illustrating preparation of the envelope for a second mailing.
Figure 4:
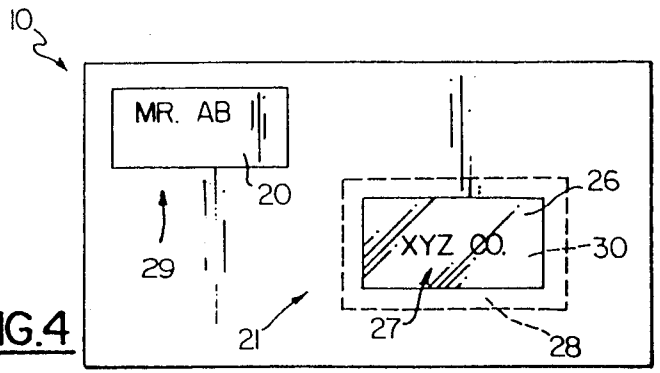
FIG. 4 shows the envelope of FIG. 3 resealed for the second mailing with the second mail-to address positioned within the boundary of the window formed by removing the label.

The outer surface of label 20 may be imprinted with a mail-to name and address, the inside surface thereof being coated with an adhesive as seen in FIG. 1 such that label 20 may be removed in accordance with the above by the person to whom label 20 was addressed, (i.e., the first addressee), and affixed to the outer surface of face 24 in the upper, left-hand corner thereof such that it henceforth serves as the return-address label, this step being illustrated more clearly in FIG. 3.

Figure 2:
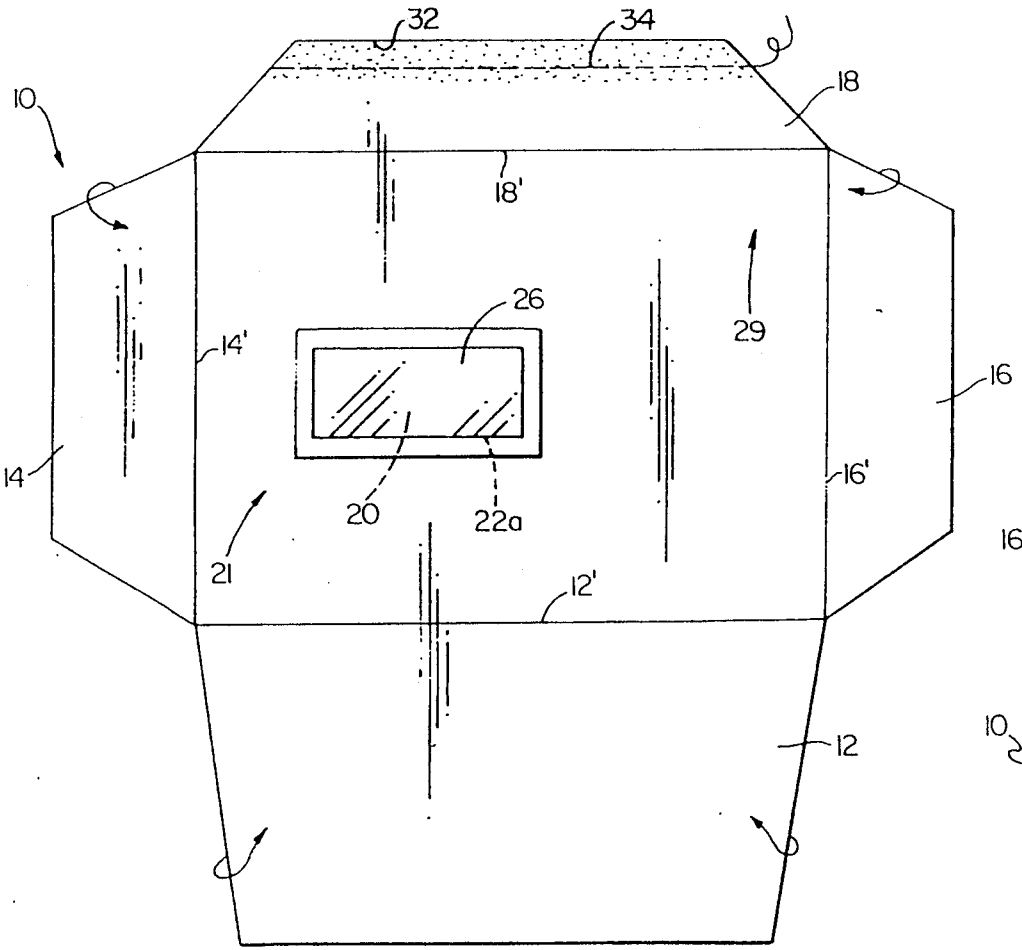
FIG. 2 is a view similar to FIG. 1 showing a transparent liner affixed in covering relation to the label, as well as another alternative label removing means.

It is optional to include a transparent liner 26 affixed along its outer edges to gummed portion 28 on the inside surface of face 24 about the perimeter of label 20. Liner 26 acts to protect the contents of envelope 10 and is affixed in covering relation to the inside, adhesive-covered surface of label 20. The adhesive used on the inside surface of label 20 may be either pressure or moisture sensitive. If pressure sensitive adhesive is preferred, liner 26 must be present to prevent label 20 from adhering to the correspondence 30 within the envelope. The adhesive used must be of a type which permits easy separation of label 20 from liner 26 while at the same time exhibit good adhesive behavior when affixed to face 24 in the conventional, return-address area 29 to serve as the return-address label. It is noted that when liner 26 is present and label 20 includes a pressure sensitive adhesive such that it adheres to liner 26 to keep it in the proper position until removed therefrom, label 20 may be a piece totally separate from envelope face 24; that is, spaced perforations 22 are not required in this case to hold label 20 in place at the mail-to location 21 on envelope 10. This is illustrated in the blank of FIG. 2, wherein label 20 is completely separated from the front panel of the envelope by continuous cut line 22*a* extending around the entire periphery of the label.

If instead of a pressure sensitive adhesive, a moisture sensitive adhesive is used on label 20, the presence of transparency 26 is optional; however, perforations 22 are required with a mositure sensitive label 20 to keep label 20 in position on face 24 until the second mailing of envelope 10 takes place after label 20 is removed by the first addressee from its mail-to position 21 on envelope 10 and affixed to the return-address location 29, effectively concealing the first sender's name and address thereon.

With label 20 removed from its first, mail-to location 21 and affixed to the return-address location 29, a window 27 is formed at the mail-to location 21 by removal of label 20 therefrom. As seen in FIG. 3, the correspondence 30, which is to be mailed by the first receiver or addressee (e.g., "Mr. AB") of envelope 10 back to the original sender (e.g., "XYZ Co.") whose address originally appeared at return-address location 29, includes the name and address of the first sender "XYZ Co." The location on correspondence 30 is such that when properly deposited into the envelope, "XYZ Co.'s" name and address appears through window 27 to be read and delivered to "XYZ Co." upon the second mailing of envelope 10.

Figure 5:
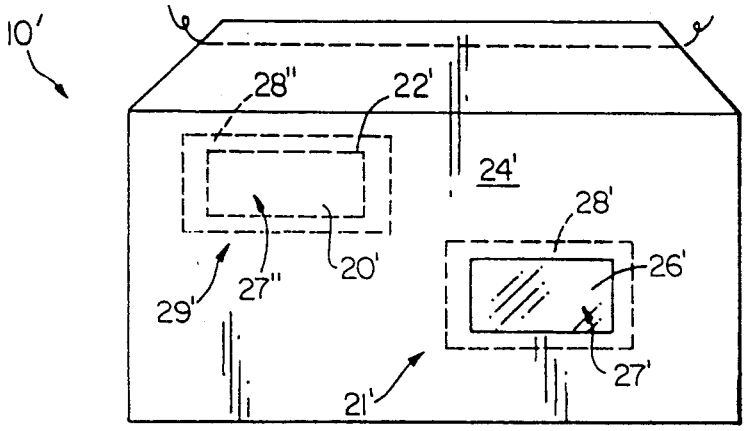
FIG. 5 is a front view of a second embodiment of the envelope of this invention in its unsealed state.

A second embodiment of envelope 10' may be seen in FIG. 5 which is essentially the reverse structure of envelope 10 discussed thus far. In particular, an opening in face 24' referred to as window 27' having optional transparent liner 26' affixed along the perimeter thereof is provided at mail-to location 21'. Correspondence deposited in envelope 10' for a first mailing includes the name and address of the addressee which appears through window 27′ when deposited in envelope 10′. The return address of the first sender is printed on label 20′ which is formed as was label 20, i.e., by perforations 22′ cut into front 24′ of envelope 10′ but in this second embodiment, at return-address location 29′. If a transparent liner is desired at return-address location 29′, it may be attached to the inside surface of face 24′ along gummed portion 28″ such that it is revealed in the window 27″ created upon removal of label 20′.

Once the first addressee has received the envelope 10′ from the first sender, the first addressee removes label 20′ which bears the first sender's name and address and affixes it at position 21′ in covering relation to window 27′ such that it provides the mail-to address for the second mailing. As aforementioned, once label 20′ has been removed from return-address location 29′, window 27″ is revealed. The correspondence the first addressee deposits in envelope 10′ for mailing back to the first sender includes the first addressee's name and address thereon in the appropriate place such that it appears through window 27″ thereby serving as the return-address label.

Having thus described the manner in which the return address and mail-to address of envelope 10 or 10′ may be interchanged to provide a double mailing of the same envelope between first and second parties, attention is now turned to the manner in which the envelopes 10 and 10′ may be sealed for the first mailing, opened by the first addressee, and resealed for a second mailing by the first addressee back to the original sender.

Figure 6:
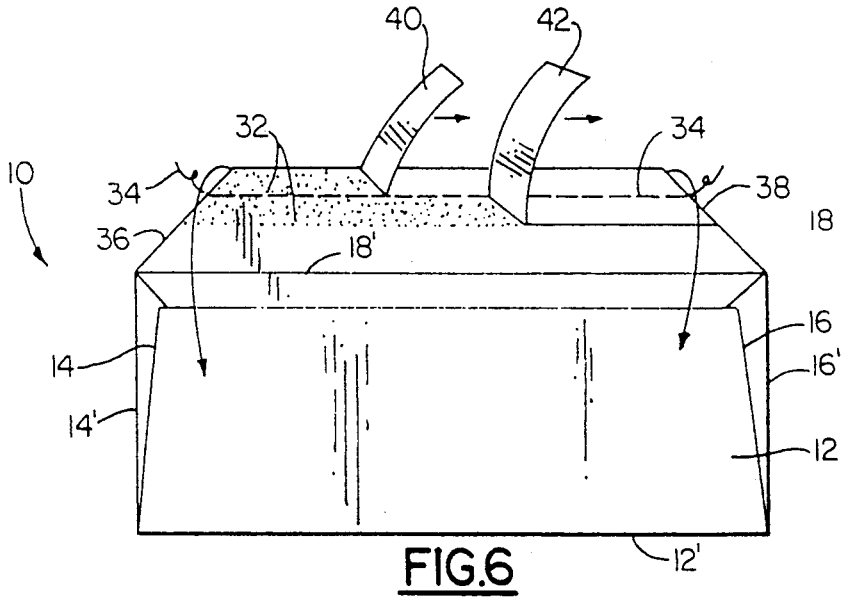
FIG. 6 is a rear, plan view of an envelope formed from the blank of FIGS. 1 or 2 folded in accordance with the directional arrows thereof and showing the manner in which first and second liners positioned on the gummed flap are removed for sealing the envelope for first and second mailings, respectively.
Figure 7:
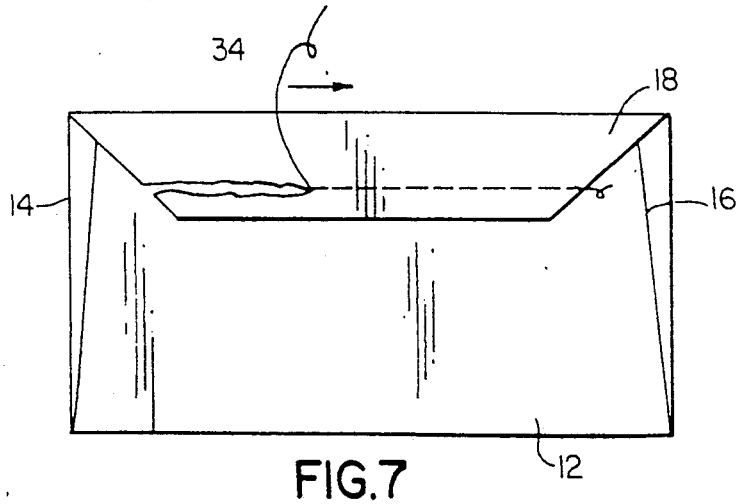
FIG. 7 shows the envelope of FIG. 6 with the gummed flap in its sealed position and the string being pulled to sever a first portion of the flap following the first mailing of the envelope.

A first manner in which a resealing of gummed flap 18 may be achieved is seen in FIGS. 6 and 7. In particular, flap 18 includes pressure sensitive adhesive material 32 affixed to the inside surface thereof and includes string 34 glued or otherwise attached to traverse flap 18 from edge 36 to edge 38 such that adhesive material 32 is located on both sides of string 34. One or both ends of string 34 extend from flap 18 for ease of manual grasping thereof. A pair of elongated, release-paper liners 40 and 42 are affixed in covering relation to pressure-sensitive adhesive 32 to protect the integrity thereof until sealing of flap 18 to the outer surface of flap 12 is required. As seen, liners 40 and 42 are placed in side by side relationship with string 34 positioned therebetween. When a first mailing of the envelope is to take place, the sender deposits the correspondence inside the envelope, peels liner 40 off adhesive 32, leaving liner 42 intact, and folds flap 18 along fold line 18′ and seals flap 18 to the outer surface of flap 12. When the envelope is received by the first addressee, the first addressee grasps an end of string 34 and pulls in the manner illustrated in FIG. 7. Removal of string 34 from flap 18 tears flap 18 into two separate portions. The portion of flap 18 adhered to flap 12 which previously was covered by liner 40 remains affixed to flap 12. Since liner 42 covers the remaining adhesive on flap 18 on the other side of now removed string 34, flap 18 may be easily lifted for access to the correspondence within the envelope. The first addressee may interchange the mail-to and return address labels in the manner heretofore described and reseal the envelope by removing liner 42 to expose adhesive 32 thereunder and folding flap 18 over flap 12. The second mailing of the envelope may then take place.

Figure 8:
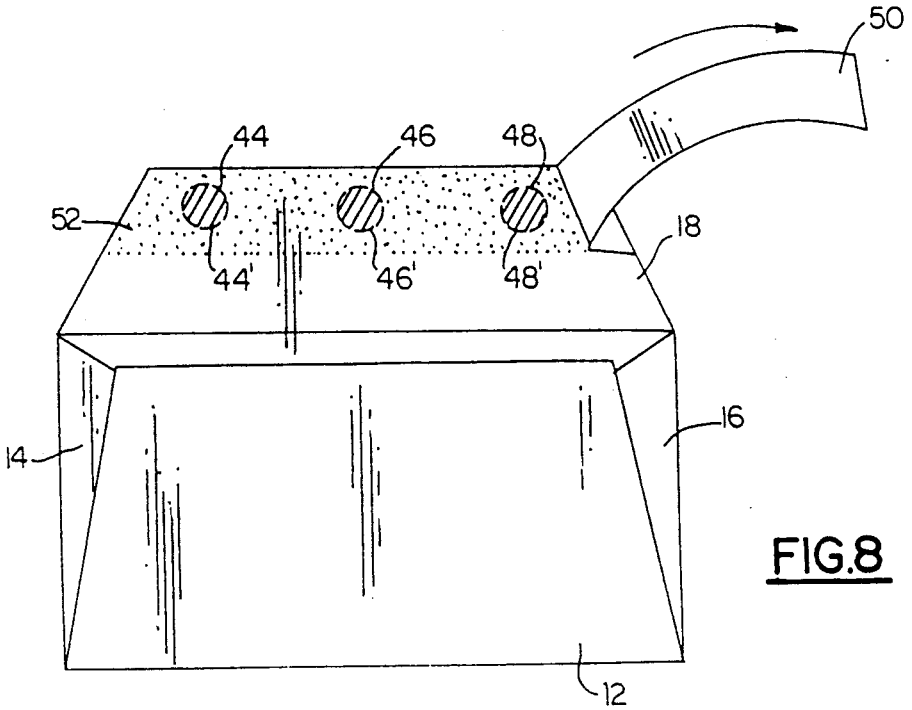
FIG. 8 is a plan view of the back of an envelope showing a second means for resealing for the second mailing.
Figure 9:
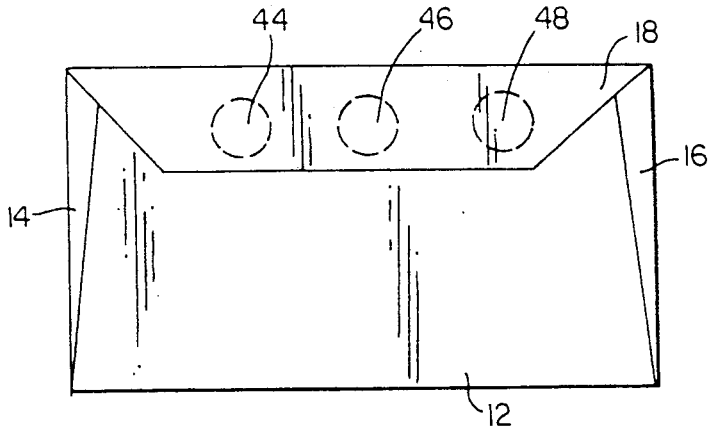
FIG. 9 is the envelope of FIG. 8 shown with the gummed flap in its sealed position.
Figure 10:
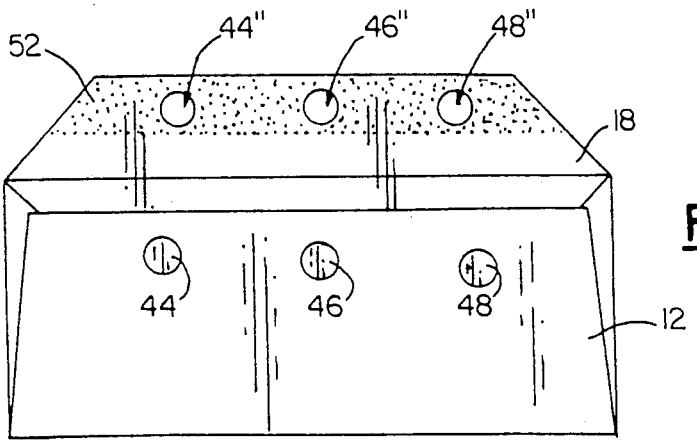
FIG. 10 is the envelope of FIG. 9 showing the flap in the open position following unsealing by the first addressee.

An alternative means of resealing flap 18 may be seen in FIGS. 8, 9 and 10. In particular, flap 18 includes three circular portions 44, 46 and 48 formed by perforations 44′, 46′ and 48′, respectively. The inside surfaces of circular portions 44, 46 and 48, seen in FIG. 8, are covered by a pressure sensitive adhesive and the portion of the inside surface of flap 18 surrounding portions 44, 46 and 48 is covered by a moisture sensitive adhesive. A release-paper liner 50 is attached in covering relation to the pressure sensitive adhesive to protect the integrity thereof until its use is required.

When the first sender wishes to mail the envelope, liner 50 is removed and the inside surface of flap 18 is pressed upon the outside surface of flap 12 as seen in FIG. 9. The pressure-sensitive adhesive on portions 44, 46 and 48 seals those portions of flap 18 to flap 12 for the mailing of the envelope from the first sender to the first addressee. When the first addressee receives the envelope, flap 18 is lifted from flap 12 whereupon flap 18 tears around perforations 44′, 46′ and 48′, leaving portions 44, 46 and 48 affixed to flap 12. The opened flap thus has holes 44″, 46″ and 48″ where circular portions 44, 46 and 48 were originally positioned as seen in FIG. 10.

After the first addressee has interchanged the mail-to and return addresses in accordance with the description above, the correspondence to be mailed back to the first sender is deposited in the envelope and the moisture-sensitive adhesive on flap 18 is moistened such that flap 18 may be resealed to flap 12. Thus, the second mailing of the envelope may take place.

It is noted that the envelope resealing means seen in FIGS. 6 and 7, and the means seen in FIGS. 8, 9 and 10 may be alternately used with either embodiment of interchanging mail-to and return address envelopes first described herein.

What is claimed is:

1. A mailing envelope for consecutive use in both forward and return mailings comprising:

a) a front panel portion having an outer surface with mail-to and return address locations thereon;

b) a rear panel portion folded and sealed with respect to said front panel portion to form a substantially rectangular enclosure closed on three sides and open on one side for deposit of correspondence;

c) a sealing flap attached to said front panel along said one side and having an adhesive region on a surface thereof movable into sealed relation with a portion of said rear panel to close said one side and seal said envelope, said adhesive region being divided into first and second regions for use in said forward and return mailings, respectively; and d) a removable and reuseable label formed by a succession of spaced, slit perforations in said front panel at one of said mail-to and return address locations, said label having a forward, address-bearing surface and a rear, adhesive-covered surface, whereby said label may be removed from its location for forward mailing by tearing around said slit perforations and adhesively secured in the other of said mail-to and return address locations for return mailing of said envelope from the original addressee to the original sender, removal of said label forming a window in said front panel for viewing an address on a portion of the envelope contents positioned behind said window.

2. The envelope of claim 1 and further including means facilitating separation of said label from said front panel.

3. The envelope of claim 2 wherein said label is substantially rectangular and facilitating means comprises at least one corner of said label wherein said slit perforations extend continuously on each of two sides of said label.

4. The envelope of claim 3 wherein said slit perforations extend continuously on each of two sides of said label at all four corners thereof.

5. The envelope of claim 2 wherein said label is substantially rectangular and said facilitating means comprises an open notch cut out of said front panel along one side of said label.

6. The envelope of claim 2 wherein said label is substantially rectangular and said facilitating means comprises an arcuate slit extending continuously along one side of said label.

7. The envelope of claim 2 and further including a transparent liner affixed to said front panel and underlying said label in said location for forward mailing, whereby said liner is in covering relation to said window upon removal of said label from said location for forward mailing.

8. The envelope of claim 7 wherein said adhesive-coated surface of said label comprises a pressure sensitive adhesive by which said label is adhered to said liner when in said location for forward mailing, and by which said label may be adhesively secured to said front panel in the other of said mail-to and return address locations for return mailing.

9. The envelope of claim 1 wherein said adhesive region of said flap is divided by a series of perforations into said two regions one of which is sealed to said rear panel for forward mailing and the other of which is sealed to said rear panel for return mailing after tearing said flap along said series of perforations following receipt and opening of said envelope by the original addressee.

10. The envelope of claim 9 wherein said series of perforations extends substantially entirely across said flap from side to side.

11. The envelope of claim 10 and further including a string affixed to said sealing flap along said series of perforations to permit tearing said flap along said series of perforations by pulling said string.

12. The envelope of claim 9 wherein said series of perforations are arranged in distinct, non-contiguous areas of said flap, whereby said flap may be sealed to said back panel for said forward mailing by the adhesive on said flap within said non-contiguous areas, and for said return mailing by the adhesive on said flap outside said non-contiguous areas after tearing said flap along said series of perforations following receipt and opening of said envelope by the original addressee, with said non-contiguous areas remaining affixed to said rear panel.

13. The envelope of claim 12 wherein the adhesive on said flap within said non-contiguous areas is a pressure sensitive adhesive and the adhesive on said flap outside said non-contiguous areas is a moisture sensitive adhesive.

14. The envelope of claim 13 wherein said non-contiguous areas are substantially circular in shape.

15. A mailing envelope for consecutive use in both forward and return mailings comprising:

a) a front panel portion have an outer surface with mail-to and return address locations thereon;

b) a rear panel portion folded and sealed with respect to said front panel portion to form a substantially rectangular enclosure closed on three sides and open on one side for deposit of correspondence;

c) a sealing flap attached to said front panel along said one side and having an adhesive region on a surface thereof movable into sealed relation with a portion of said rear panel to close said one side and seal said envelope, said adhesive region being divided into first and second regions for use in said forward and return mailings, respectively; and d) a removable and reuseable label formed in said front panel at one of said mail-to and return address locations, said label having a forward, address-bearing surface and a rear surface substantially covered by a pressure-sensitive adhesive, said label being removable from said one of said locations to form a window in said front panel following said forward mailing and placed in the other of said locations for said return mailing; and e) a transparent liner affixed to said front panel in underlying relation to said label in said one of said locations, whereby said label is releasably attached by said pressure-sensitive adhesive to said liner in said one of said locations and may be removed and attached to said front panel in said other of said locations for said return mailing, said window providing means for viewing through said liner an address on a portion of the envelope contents positioned behind said window.

16. The envelope of claim 15 wherein said label is substantially rectangular and is separated from said front panel by a cut line extending entirely about the periphery of said label in said one of said locations, said label being supported therein solely by attachment to said liner by said pressure-sensitive adhesive.

17. A mailing envelope for consecutive use in both forward and return mailings comprising:

a) a front panel portion having an outer surface with mail-to and return address locations thereon;

b) a rear panel portion folded and sealed with respect to said front panel portion to form a substantially rectangular enclosure closed on three sides and open on one side for deposit of correspondence;

c) a removable and reuseable label formed in said front panel at one of said mail-to and return address locations, said label having a forward, address-bearing surface and a rear, adhesive-covered surface, said label being removable from said one of said locations to form a window in said front panel following said forward mailing and placed in the other of said locations for said return mailing;

d) a sealing flap attached to said front panel along said one side and having an adhesive region on a surface thereof movable into sealed relation with a portion of said rear panel to close said one side and seal said envelope, said adhesive region being divided into first and second regions for use in said forward and return mailings, respectively;

e) said first adhesive region comprising a plurality of non-contiguous areas, each separated from surrounding portions of said flap by a series of perforations, said surrounding portions forming said second adhesive region, whereby said flap may be sealed to said back panel for said forward mailing by the adhesive on said non-contiguous areas, and for said return mailing by the adhesive on said surrounding portions after tearing said flap along said series of perforations following receipt and opening of said envelope by the original addresses, with said non-contiguous areas remaining affixed to said rear panel.

18. The envelope of claim 17 wherein said adhesive on said non-contiguous areas is a pressure-sensitive adhesive, and said adhesive on said surrounding portions is a moisture-sensitive adhesive.

19. The envelope of claim 18 wherein said non-contiguous areas are substantially circular in outline.

20. The envelope of claim 18 and further including an elongated strip of release paper covering said pressure-sensitive adhesive to protect the integrity thereof prior to use for said forward mailing.

* * * * *